United States Patent [19]

Futterer

[11] Patent Number: 4,480,518

[45] Date of Patent: Nov. 6, 1984

[54] APPARATUS FOR TRIMMING THE MARGINAL PORTIONS OF PAPER SHEETS OR THE LIKE

[75] Inventor: Klaus-Jürgen Futterer, Ostfildern, Fed. Rep. of Germany

[73] Assignee: Grapha-Holding AG, Hergiswil, Switzerland

[21] Appl. No.: 389,982

[22] Filed: Jun. 18, 1982

[30] Foreign Application Priority Data

Jul. 15, 1981 [CH] Switzerland ..... 4632/81

[51] Int. Cl.[3] ..... B26D 1/20

[52] U.S. Cl. ..... 83/508; 83/349; 83/676; 83/925 A

[58] Field of Search ..... 83/508, 500, 332, 349, 83/673, 675, 676, 925 A

[56] References Cited

U.S. PATENT DOCUMENTS

| | | | |
|---|---|---|---|
| 1,510,782 | 10/1924 | Hussey | 241/294 X |
| 1,676,048 | 7/1928 | Philbrick | 83/349 |
| 2,771,949 | 11/1956 | Sigoda | 83/508 |
| 3,726,167 | 4/1973 | Barbour | 83/676 |

*Primary Examiner*—Donald R. Schran
*Attorney, Agent, or Firm*—Peter K. Kontler

[57] ABSTRACT

An apparatus for simultaneously trimming both lateral marginal portions of a scalloped stream of sheets has a transporting unit which is driven to advance the stream in a horizontal cutting plane flanked by two stationary counterknives which are mounted below the cutting plane and whose cutting portions are disposed in the cutting plane. The sheets in the cutting plane are biased against the transporting unit and their marginal portions are trimmed by the cutting edges of radial knives mounted on two coaxial rotary holders disposed at a level above the cutting plane and each cooperating with a different one of the counterknives. The cutting edges of the knives are inclined with reference to the longitudinal directions of the respective knives and orbit along endless paths which are intersected by the cutting plane so that each cutting edge which reaches the cutting plane moves below such plane before beginning to move upwardly and above the cutting plane. The cutting plane and the cutting edges make an angle of 0°–15° when the cutting edges reach the cutting plane, and the angle between the cutting plane and the cutting edges is 15°–45° when the respective knives extend at right angles to the cutting plane so that the cutting edges are disposed in the lowermost portions of their respective endless paths. The speed at which the cutting edges orbit greatly exceeds the speed of travel of sheets in the cutting plane.

11 Claims, 3 Drawing Figures

APPARATUS FOR TRIMMING THE MARGINAL PORTIONS OF PAPER SHEETS OR THE LIKE

BACKGROUND OF THE INVENTION

The present invention relates to apparatus for trimming paper sheets or the like, and more particularly to improvements in apparatus for trimming the lateral marginal portions of sheets which are transported seriatim along a predetermined path. Still more particularly, the invention relates to improvements in trimming apparatus of the type wherein the marginal portions of sheets or accumulations of sheets are trimmed by cooperating counterknives and orbiting knives adjacent to one or more portions of a path which is defined by the means for transporting the sheets.

Apparatus for trimming marginal portions of paper sheets or the like are disclosed in German Offenlegungsschrift No. 25 58 045 and in U.S. Pat. No. 3,813,981 granted Jun. 4, 1974 to Faltin. The German publication discloses an apparatus including a rotary disc-shaped knife having a circular cutting edge and cooperating with the circular cutting edge of a rotary counterknife. Such apparatus is capable of adequately trimming relatively thin sheets or relatively thin piles of overlapping or folded sheets. It has been found, however, that the apparatus which is described in this German publication is not suited for trimming relatively thick newspapers, brochures, pamphlets or analogous accumulations of superimposed or folded-over sheets. Even relatively thin sheets or relatively thin accumulations of sheets are likely to slide relative to the circular cutting edges of the knife and counterknife.

The apparatus of U.S. Pat. No. 3,813,981 to Faltin is more suitable for the trimming of marginal portions of relatively thick accumulations of sheets, such as newspapers, brochures or the like. However, this apparatus exhibits the drawback that the trimming operation is satisfactory only if the peripheral speed of the rotary knives matches the speed at which the material to be trimmed is advanced past the cutting station. Furthermore, the trimming action is adversely affected by the recessed cutting edges, and the dimensions of trimmed sheets merely approximate but cannot exactly match the optimum dimensions.

OBJECTS AND SUMMARY OF THE INVENTION

An object of the invention is to provide a trimming apparatus which is capable of performing a highly satisfactory trimming action irrespective of the thickness of materials which are being treated and irrespective of the speed at which the materials are transported through the trimming station.

Another object of the invention is to provide an apparatus which can be used as a superior substitute for heretofore known trimming apparatus to trim the marginal portions of relatively thick commodities such as stacks of paper sheets in the form of pamphlets, brochures, newspapers, books or the like.

A further object of the invention is to provide a trimming apparatus which can simultaneously treat two marginal portions of each of a short or long series of successive partially overlapping or non-overlapping commodities.

An additional object of the invention is to provide an apparatus which can trim selected marginal portions of sheets (such as the front, foot or head edges of folded-over paper sheets) with a heretofore unmatched degree of accuracy and reproducibility, even if the commodities to be trimmed are transported at a very high speed and even if such commodities are thick or very thick.

Another object of the invention is to provide novel and improved severing means for use in an apparatus of the above outlined character.

A further object of the invention is to provide an apparatus wherein the speed of the knife or knives need not match the speed at which the commodities are transported through the trimming or cutting station.

An ancillary object of the invention is to provide a novel and improved mounting of the component parts of severing means in an apparatus of the above outlined character.

The invention is embodied in an apparatus for trimming lateral marginal portions of sheets, particularly piles of paper sheets (e.g., brochures, pamphlets, newspapers or the like) which form a scalloped stream of partly overlapping sheets. The apparatus comprises a transporting unit which serves to advance a succession of sheets along a predetermined path and defines a preferably at least substantially horizontal cutting plane in a predetermined portion of such path, and severing means which includes at least one preferably stationary counterknife adjacent to one side of the path and having a cutting portion disposed in the region of the cutting plane, a rotary knife holder at the other side of the path opposite the counterknife, and at least one preferably elongated knife extending substantially radially of the holder and having a cutting edge which orbits along an endless path a portion of which extends beyond the cutting plane and to the one side of the predetermined path, i.e., the cutting edge approaches the cutting plane, crosses the cutting plane to cooperate with the cutting portion of the counterknife in severing the respective marginal portions of the sheets in the predetermined path, and moves (at least in part) beyond the cutting plane to the other side of the predetermined path before returning to the one side of the predetermined path. In accordance with a feature of the invention, the inclination of the cutting edge relative to the longitudinal direction of the knife and the extent to which the cutting plane intersects the endless path for the cutting edge of the knife are selected in such a way that the cutting edge and the cutting plane make an angle of 0°–15° when the cutting edge reaches the cutting plane, and that the cutting edge and the cutting plane make an angle of 15°–45° when at least a portion of the cutting edge extends to a maximum extent to the one side of the predetermined path. The arrangement may be such that the elongated knife and the cutting plane make an angle which at least approximates 90° when the cutting edge and the cutting plane make an angle of 15°–45°. The holder is preferably disposed at a level above the cutting plane and the cutting edge preferably makes an acute angle with the longitudinal direction of the knife. The severing means preferably comprises a plurality of elongated knives whose cutting edges are equally spaced from one another, as considered in the circumferential direction of the holder. The cutting edges of the entire annulus of knives are disposed in the endless path, and the inclination of each cutting edge with reference to the cutting plane, at the time the cutting edges come in contact with the sheets in the predetermined portion of their path as well as at the time the respective knives are substantially perpendicular to the cutting plane, is preferably identical.

The apparatus preferably further comprises mobile biasing means (such as one or more endless belts or bands) for yieldably urging the sheets against the transporting unit while the sheets advance along the predetermined portion of their path. Still further, the apparatus preferably comprises means for driving the transporting unit (and preferably also the biasing means) at a first speed and for driving the holder at a second speed such that the speed of orbital movement of the cutting edge or cutting edges along the endless path greatly exceeds the first speed.

In accordance with a presently preferred embodiment of the invention, the severing means of the improved apparatus preferably further comprises a second counterknife disposed at one side of the predetermined path and having a cutting portion in the region of the cutting plane, a second rotary knife holder disposed at the other side of the predetermined path opposite the second counterknife, and at least one second knife extending substantially radially of the second holder and having a cutting edge arranged to orbit along a second endless path a portion of which extends beyond the cutting plane and to the one side of the predetermined path. The second cutting edge and the cutting plane make an angle of 0°–15° when the second cutting edge reaches the cutting plane, and an angle of 15°–45° when at least a portion of the second cutting edge extends to a maximum extent beyond the cutting plane and to the one side of the predetermined path. The two holders are preferably rotatable about a common axis. The just discussed apparatus preferably also comprises biasing means for urging the sheets against the transporting unit when the sheets are located in the cutting plane; the two counterknives are preferably stationary; and the two holders are preferably disposed at a level above the preferably horizontal cutting plane.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
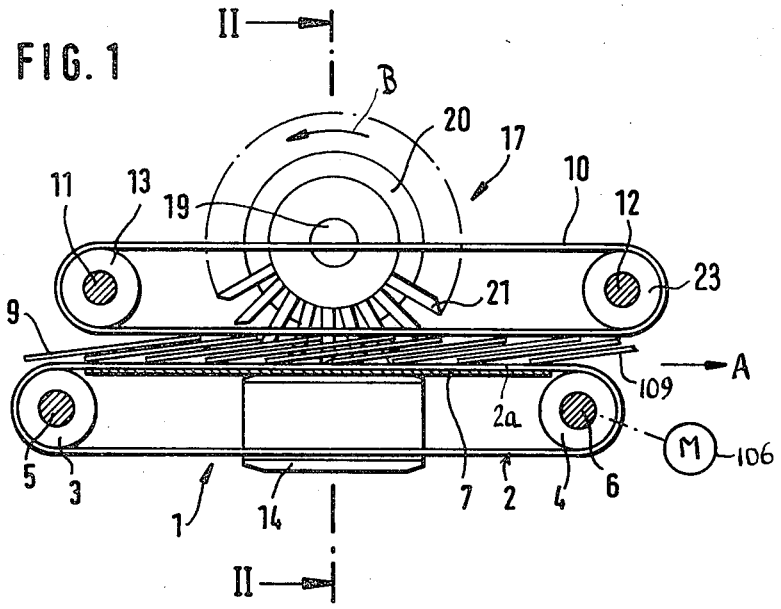
FIG. 1 is a longitudinal vertical sectional view of a trimming apparatus which embodies one form of the invention, the section being taken along the line I—I of FIG. 2 as seen in the direction of arrows.
Figure 2:
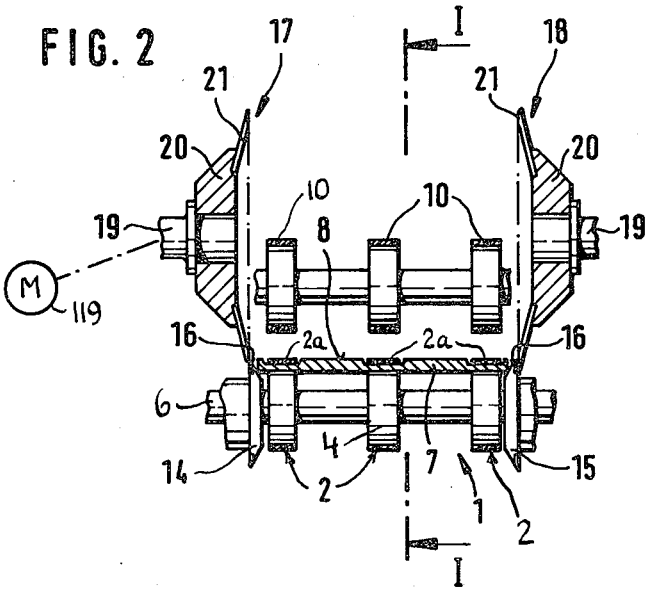
FIG. 2 is a transverse vertical sectional view as seen in the direction of arrows from the line II—II of FIG. 1.
Figure 3:
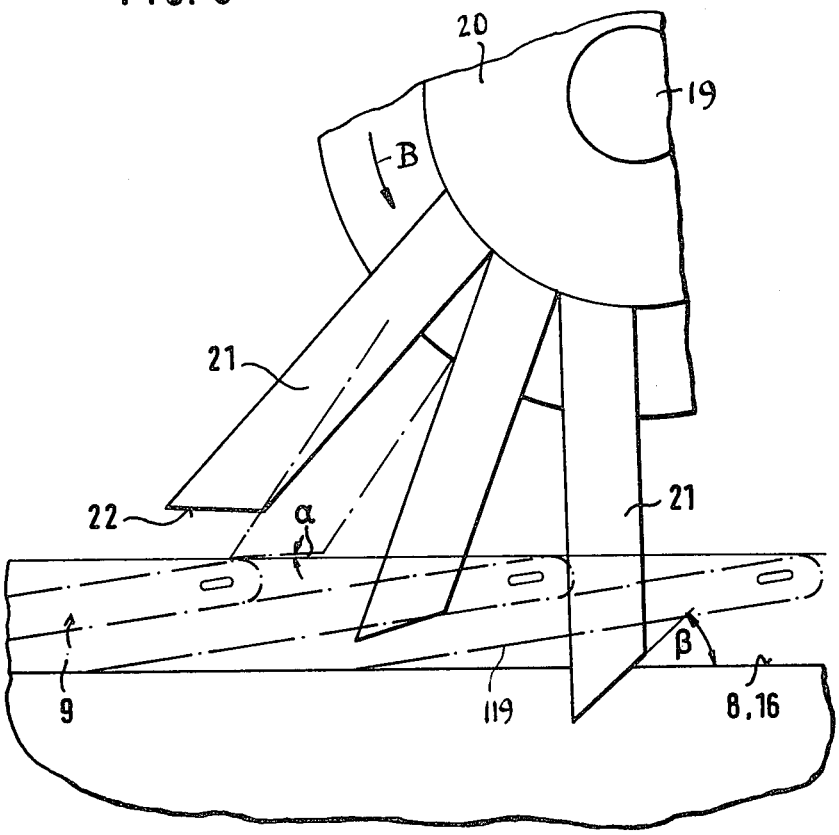
FIG. 3 is an enlarged view of a detail in FIG. 1.

The apparatus which is shown in FIGS. 1 to 3 comprises a transporting unit 1 including three endless belt conveyors 2 which are disposed in parallel vertical planes and are trained over pulleys 3, 4 which, in turn, are mounted on shafts 5, 6, respectively. The front shaft 6 is driven by a motor 106 so that the horizontal upper reaches 2*a* of the conveyors 2 advance in the direction indicated by arrow A. The upper reaches 2*a* cooperate with a stationary platform 7 to define a horizontal cutting plane 8 disposed in a predetermined portion of the path which is defined by the transporting unit 1. The unit 1 transports a continuous stream 9 of partially overlapping paper sheets 109, e.g., a stream of brochures, pamphlets, newspapers or the like which are supplied to the conveyors 2 by a suitable folding, gathering, stapling or other machine, not shown.

The apparatus further comprises a biasing unit including three endless belts 10 which are disposed in parallel vertical planes at a level above the cutting plane 8. The belts 10 are trained over pulleys 13 and 23 which are respectively mounted on shafts 11 and 12. The front shaft 12 is driven by the motor 106 so that the speed of the belts 10 matches the speed of the belt conveyors 2. The lower reaches of the belts 10 bear against the stream 9 and urge the sheets 109 against the platform 7 as well as against the upper reaches 2*a* of the belt conveyors 2 so as to prevent any or any appreciable shifting of sheets 109 relative to each other while the two marginal portions of the stream 9 are trimmed by the cutting edges 22 of two sets of elongated knives 21 which cooperate with the elongated cutting portions 16 of two stationary counterknives 14 and 15 mounted at a level below the cutting plane 8. The cutting portions 16 are located in or very close to the cutting plane 8.

The counterknives 14 and 15 form part of a severing unit which further comprises two rotary knife holders 17, 18 mounted on a common horizontal drive shaft 19 or on two discrete coaxial drive shafts driven by a motor 119 at a speed such that the speed of orbital movement of cutting edges 22 in their respective endless paths greatly exceeds the speed of the belt conveyors 2 and belts 10. The directions in which the holders 17, 18 are driven by the motor 119 are indicated by the arrow B. Each of the holders 17, 18 comprises a hub 20 which carries the respective set of radially extending elongated knives 21. The cutting edges 22 (see FIG. 3) of the knives 21 are elongated and each such cutting edge makes an acute angle with the longitudinal direction of the respective knife 21. The cutting edges 22 slope inwardly from the trailing toward the front end faces of the respective knives 21 and their inclination is such that, when a cutting edge 22 reaches the cutting plane 8, this cutting edge and the cutting plane make an angle alpha of 0°–15°. When the cutting edge 22 thereupon continues to move downwardly along the respective endless path (which is intersected by the cutting plane 8), the cutting plane 8 and the cutting edge which extends at least in part beyond the cutting plane and below the horizontal portion of the endless path defined by the upper reaches 2*a* and platform 7 make an acute angle beta of 15°–45°. This takes place when the corresponding knife 21 is at least substantially normal to the cutting plane 8 and the cutting edge 22 is disposed at its lower end. Such orientation of cutting edges 22 with reference to the cutting plane 8 ensures that the severing means including the counterknives 14, 15 and the holders 17, 18 can cleanly trim the marginal portions of relatively thick sheets 109 as well as the marginal portions of relatively thick piles or accumulations of sheets (such as brochures, pamphlets, newspapers or the like). It has been found that the just discussed orientation of cutting edges 22 with reference to the cutting plane 8 (at the time the cutting edges 22 reach the plane 8 and at the time the knives 21 are perpendicular to the plane 8) ensures highly satisfactory simultaneous trimming of the two lateral marginal portions of each of a series of partially overlapping or non-overlapping sheets even if the belt conveyors 2 are driven at a high or very high speed.

When the apparatus is in use, the motor 106 drives the belt conveyors 2 and the belts 10 so that the upper reaches *2a* of the conveyors 2 and the lower reaches of the belts 10 travel in the direction of arrow A at the identical or nearly identical speed. The motor 119 drives the shaft or shafts 19 so that the holders 17, 18 rotate in the direction indicated by the arrow B. The upper reaches *2a* of the belt conveyors 2 receive successive sheets 109 of the scalloped stream 9 and both lateral marginal portions of each sheet 109 are trimmed by the cutting edges 22 during travel in the cutting plane 8, i.e., along the upper side of the platform 7 and with the upper reaches *2a* of the conveyors 2. The belts 10 ensure that the sheets 109 cannot change their orientation during travel along the platform 7, i.e., that the sheets 109 cannot change their positions relative to each other and/or relative to the conveyors 2 and counterknives 14, 15. The speed of orbital movement of the cutting edges 22 of knives 21 can be a multiple of the speed of lengthwise movement of upper reaches *2a* of the belt conveyors 2. The distance between the vertical planes in which the two sets of knives 21 orbit is selected in such a way that it matches the desired width of trimmed sheets 109. It is assumed that each of the sheets 109 comprises at least two panels which are joined along the back (the latter is assumed to extend transversely of the direction which is indicated by the arrow A) and that the two sets of cutting edges 22 trim the foot and head ends of the sheets. The aforediscussed selection of the angles alpha and beta ensures that the cutting edges 22 are inclined with reference to the cutting portions 16 of the counterknives 14, 15 while the knives 21 cooperate with the respective counterknives to sever the sheets 109. This ensures the making of clean cuts at a low speed, at a medium speed or at a high speed of the belt conveyors 2.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for trimming lateral marginal portions of piles of paper sheets which form a scalloped stream, comprising a transporting unit arranged to advance a succession of sheets along a predetermined path and defining a cutting plane in a predetermined portion of said path; and severing means including at least one counterknife adjacent to one side of said path and having a cutting portion in the region of said plane, a rotary knife holder at the other side of said path opposite said counterknife, and at least one knife extending substantially radially of said holder and having a cutting edge arranged to orbit along an endless path a portion of which extends beyond said plane and to said one side of said predetermined path, said cutting edge and said plane making an angle of 0°–15° when said cutting edge reaches said plane and an angle of 15°–45° when at least a portion of said cutting edge extends to a maximum extent to said other side of said predetermined path.

2. The apparatus of claim 1, wherein said knife is elongated and extends substantially at right angles to said plane when said cutting edge and said plane make said angle of 15°–45°.

3. The apparatus of claim 1, wherein said counterknife is stationary.

4. The apparatus of claim 1, wherein said cutting plane is at least substantially horizontal and said holder is disposed at a level above said plane.

5. The apparatus of claim 1, wherein said knife is elongated and said cutting edge makes an acute angle with the longitudinal direction of said knife.

6. The apparatus of claim 1, wherein said severing means comprises a plurality of elongated knives extending substantially radially of said holder and each having a cutting edge disposed in said endless path.

7. The apparatus of claim 1, further comprising means for biasing the sheets in said plane against said transporting unit.

8. The apparatus of claim 1, further comprising means for driving said transporting unit at a first speed and for driving said holder at a second speed such that the speed of orbital movement of said cutting edge along said endless path greatly exceeds said first speed.

9. The apparatus of claim 1, wherein said severing means further comprises a second counterknife disposed at said one side of said predetermined path and having a cutting portion in the region of said plane, a second rotary knife holder disposed at said other side of said predetermined path opposite said second counterknife, and at least one second knife extending substantially radially of said second holder and having a cutting edge arranged to orbit along a second endless path a portion of which extends beyond said plane and to said one side of said predetermined path, said second cutting edge and said plane making an angle of 0°–15° when said second cutting edge reaches said plane and an angle of 15°–45° when at least a portion of said second cutting edge extends to a maximum extent to said other side of said predetermined path, said counterknives flanking said plane so that said cutting edges cooperate with the respective cutting portions to trim the respective marginal portions of sheets in said portion of said predetermined path.

10. The apparatus of claim 9, wherein said holders are rotatable about a common axis.

11. The apparatus of claim 9, wherein at least one of said counterknives is stationary, wherein said plane is at least substantially horizontal, and wherein said holders are disposed at a level above said plane, and further comprising driven biasing means for urging the sheets in said plane against said transporting unit.

* * * * *